US012440030B2

(12) United States Patent
Park

(10) Patent No.: US 12,440,030 B2
(45) Date of Patent: Oct. 14, 2025

(54) BOTTOM BASE FOR PREVENTING CHAIR FALL DOWN AND CHAIR COMPRISING THE SAME

(71) Applicant: TROUND INC., Hanam-si (KR)

(72) Inventor: Jea Bum Park, Namyangju-si (KR)

(73) Assignee: TROUND INC., Hanam-si (KR)

( * ) Notice: Subject to any disclaimer, the term of this patent is extended or adjusted under 35 U.S.C. 154(b) by 0 days.

(21) Appl. No.: 18/364,889

(22) Filed: Aug. 3, 2023

(65) Prior Publication Data

US 2024/0049883 A1 Feb. 15, 2024

(30) Foreign Application Priority Data

Aug. 9, 2022 (KR) ..... 10-2022-0099176

(51) Int. Cl.

| | |
|---|---|
| ***A47C 1/124*** | (2006.01) |
| ***A47C 7/00*** | (2006.01) |
| ***A47C 7/72*** | (2006.01) |

(52) U.S. Cl.

CPC ..... *A47C 7/002* (2013.01); *A47C 7/72* (2013.01)

(58) Field of Classification Search

CPC ..... A47C 7/002; A47C 7/72; A47C 7/006; A47C 7/742; A47C 7/748; A47C 7/727; A47C 9/00; A47C 7/004; A47B 97/00

See application file for complete search history.

(56) References Cited

U.S. PATENT DOCUMENTS

| | | | | |
|---|---|---|---|---|
| 8,011,707 | B1 * | 9/2011 | Summers | A47C 1/124 280/47.35 |
| 9,827,162 | B1 * | 11/2017 | Vidmar | A47C 7/006 |
| 2015/0060156 | A1 * | 3/2015 | Husted | A61G 5/1035 297/423.26 |

FOREIGN PATENT DOCUMENTS

| | | | |
|---|---|---|---|
| JP | 2004-008284 | A | 1/2004 |
| JP | 2009-172086 | A | 8/2009 |
| KR | 20-0365912 | Y1 | 10/2004 |
| KR | 20-0401895 | Y1 | 11/2005 |
| KR | 10-2352425 | B1 | 1/2022 |

* cited by examiner

*Primary Examiner* — Amy J. Sterling
(74) *Attorney, Agent, or Firm* — Studebaker Brackett PLLC

(57) ABSTRACT

The present invention relates to a bottom base for preventing a chair from falling down and a chair including the same, and more specifically, to a bottom base capable of preventing a chair from falling down when the center of gravity of the chair is biased in a specific direction, and a chair including the same.

12 Claims, 7 Drawing Sheets

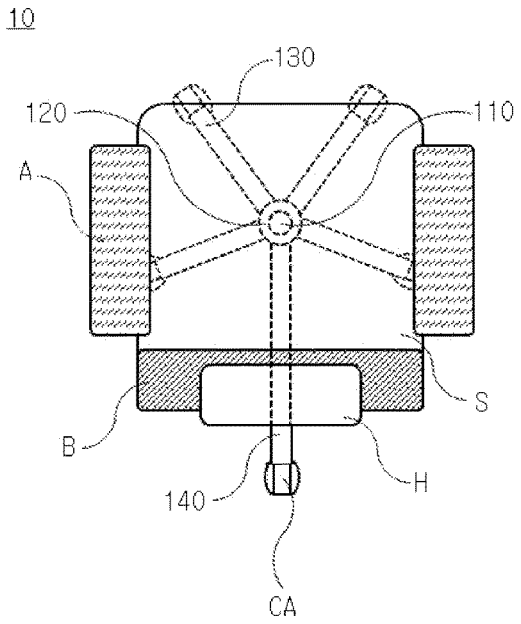
FIG. 2A
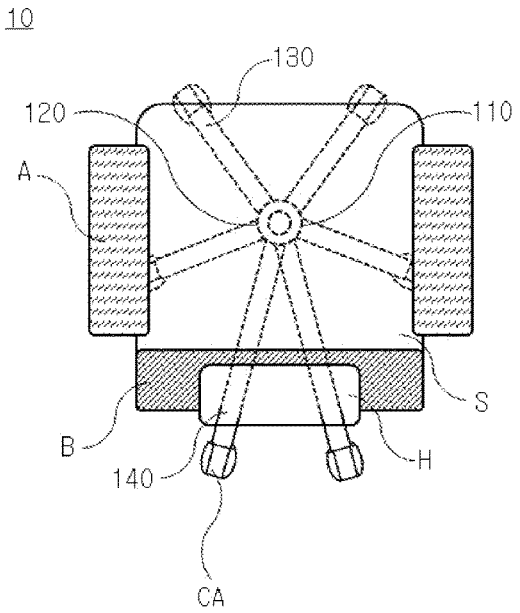
FIG. 2B
FIG. 3A
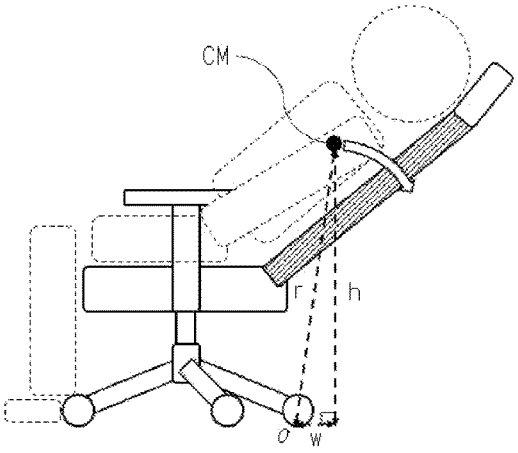
FIG. 3B
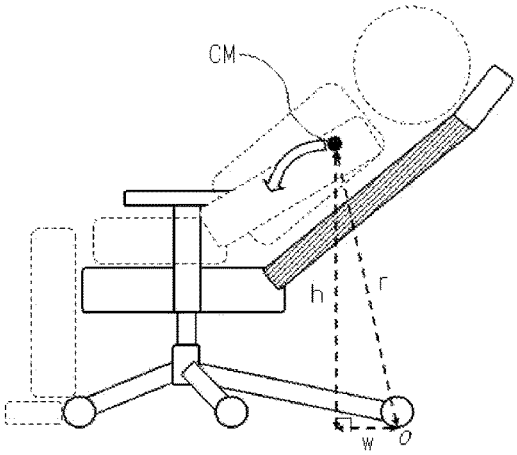

BOTTOM BASE FOR PREVENTING CHAIR FALL DOWN AND CHAIR COMPRISING THE SAME

CROSS-REFERENCE TO RELATED APPLICATION

This application claims priority to and the benefit of Korean Patent Application No. 10-2022-0099176, filed on Aug. 9, 2022, the disclosure of which is incorporated herein by reference in its entirety.

BACKGROUND

1. Field of the Invention

The present invention relates to a bottom base for preventing a chair from falling down and a chair including the same, and more specifically, to a bottom base capable of preventing a chair from falling down when the center of gravity of the chair is biased in a specific direction, and a chair including the same.

2. Discussion of Related Art

In general, a chair includes a bottom base supported on a floor, a seat part provided above the legs for a user to sit on, an armrest part for supporting the user's arm, a backrest part for supporting the user's back, and a headrest part for supporting the user's head.

For such a chair, in order to improve the convenience of seating and/or movement of a user, chairs with modifications in material or structure, such as providing a bottom base to which movable members such as wheels are added, improving seating comfort through changing a material of the seat part, introducing a backrest part allowing an angle to be adjusted, or the like, have been proposed according to characteristics of brands of each manufacturer.

In recent years, a multimedia chair with a speaker or display device installed on the chair has been introduced to meet the various needs of consumers.

Specifically, in the case of watching a movie or playing a game through a computer, in a state in which the user is sitting on a chair capable of allowing the user to see a computer monitor, the user may watch images displayed on a computer screen with his or her eyes, and at the same time, vibrations corresponding to the images are transmitted to the user's ears by vibrations of a speaker that vibrates when an electric signal is transmitted, and thus the user may hear sound.

For a multi-channel sound system having a plurality of speakers, there is an advantage in that a user may more precisely experience a direction and size of sound in an image.

However, when a multimedia device such as a speaker is installed on a chair, due to the weight of the device, the center of gravity of the chair may be biased in a specific direction compared to the center of gravity before installation, and in particular, when the multimedia device is installed on the backrest part or headrest part, there is a risk that the chair may fall down when the user adjusts the inclination of the backrest part backward.

In particular, since support legs of the bottom base for supporting the weight of the chair are generally formed radially from a central shaft (central bar) and/or a housing surrounding the central shaft, there is a problem in that it is difficult to prevent the chair from falling down when the center of gravity of the chair is excessively biased in a specific direction.

As described above, when the chair on which a multimedia device is installed falls down, not only the chair and the multimedia device may be damaged, but also there is a risk of injury to the user.

SUMMARY OF THE INVENTION

Under such a technical background, the present invention is directed to providing a bottom base capable of preventing a chair from falling down when the center of gravity of the chair is biased in a specific direction.

The present invention is also directed to providing a chair, which includes at least 1) a headrest part for supporting a user's head, 2) a backrest part for supporting a user's back and waist, and 3) a seat part for supporting a user's buttocks and legs, wherein a bottom base capable of preventing the chair from falling down even when the center of gravity is biased in a specific direction is provided under the seat part.

The present invention is also directed to providing a chair capable of implementing a multi-channel sound system by including a speaker mounting member installed on at least one of the headrest part, the backrest part, and the seat part and implementing the multi-channel sound system around a user sitting on the chair by receiving a multi-channel sound signal.

Objects of the present invention are not limited to those mentioned above, and other objects of the present invention that are not mentioned above could be understood by the detailed description and be more clearly understood from embodiments set forth in the present invention. Further, it will be readily understood that objects and advantages of the present invention may be implemented by means set forth in the claims and combinations thereof.

According to an aspect of the present invention, there is provided a bottom base for preventing a chair from falling down, including a central shaft, a housing, and a plurality of support legs.

The plurality of support legs each having a shape extending from the housing by a predetermined length may include a first support leg and at least one second support leg having an extension length longer than an extension length of the first support leg, thereby making it possible to prevent the chair from falling down even when the center of gravity of the chair is biased in a specific direction.

In one embodiment, as the second support leg is disposed from the housing toward the rear, it is possible to prevent the chair from falling down when the center of gravity of the chair is biased toward the rear.

In this case, in order to compensate for the fact that the second support leg may be more vulnerable to deformation than the first support leg because the second support leg has the extension length longer than the first support leg, a reinforcing frame for connecting the plurality of support legs spaced apart from each other may be provided.

According to another aspect of the present invention, by forming a plurality of central shafts and arranging the central shafts along a direction from the front to the rear of the chair, it is possible to prevent the chair from falling down when the center of gravity of the chair is biased to the rear.

According to still another aspect of the present invention, there is provided a chair including a bottom base capable of preventing the chair from falling down, the chair including a speaker mounting member that is installed on at least one of a headrest part, a backrest part and a seat part and in which at least speaker installation region is defined, thereby making it possible to implement a multi-channel sound system.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which:

FIGS. 2A and 2B are plan views of the chair shown in FIG. 1;

FIG. 3A is a side view illustrating the center of gravity of a user sitting on a chair when all of a plurality of support legs are the same, and FIG. 3B is a side view illustrating the center of gravity of a user sitting on a chair when a length of at least one of the plurality of support legs is different;

DETAILED DESCRIPTION OF EXEMPLARY EMBODIMENTS

Certain terms are defined herein for convenience in order to more readily understand the present invention. Unless otherwise defined herein, scientific and technical terms used in the present invention should have meanings commonly understood by one of ordinary skill in the art. In addition, it should be understood that terms in the singular form also include their plural forms, and terms in the plural form also include their singular forms, unless otherwise specified in context.

Terms "front" and/or "rear" as used herein refer to a direction in which a user faces the front and a direction in which the back of the user faces, respectively, when the user sits on a chair including a seat part and a backrest part.

Hereinafter, a bottom base for preventing a chair from falling down according to the present invention and a chair including the bottom base will be described in more detail.

Bottom Base

Figure 1:
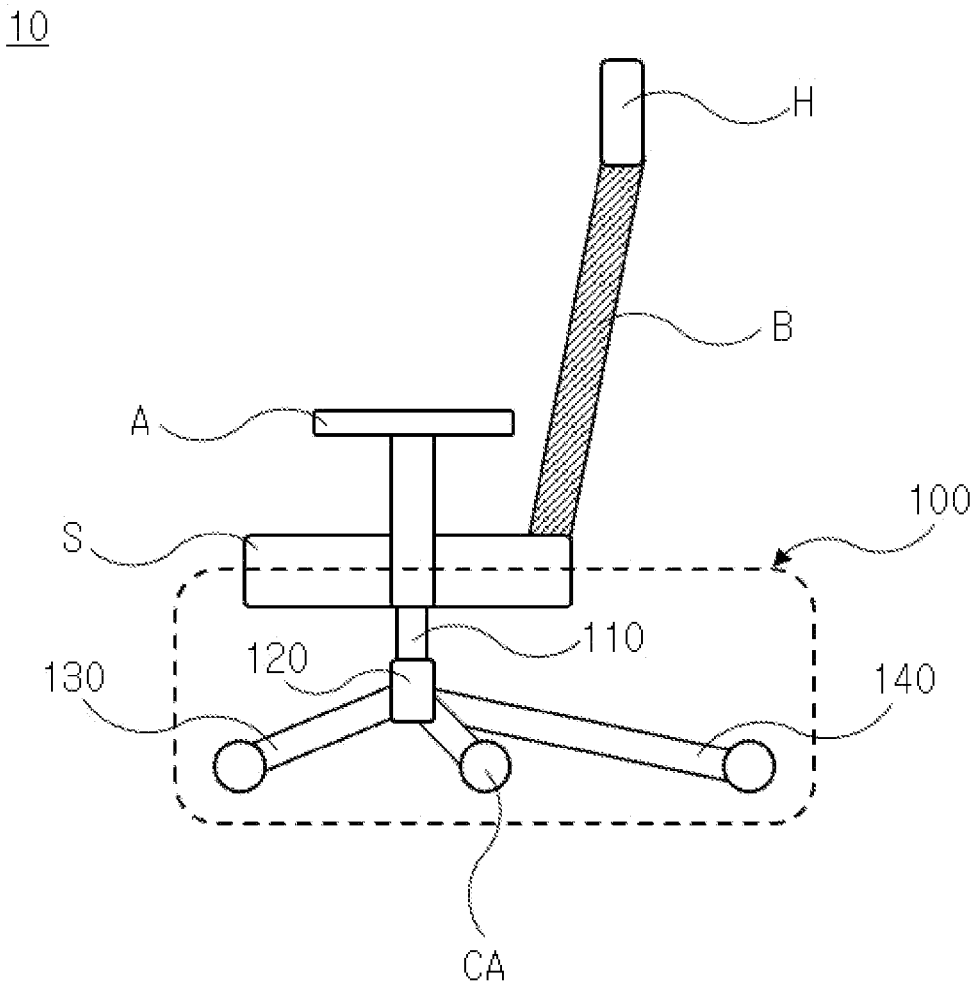
FIG. 1 is a side view of a chair including a bottom base according to one embodiment of the present invention.

FIG. 1 is a side view of a chair including a bottom base according to one embodiment of the present invention, and FIGS. 2A and 2B are plan views of the chair shown in FIG. 1.

Referring to FIGS. 1 to 2B, a bottom base 100 includes a central shaft 110, a housing 120, and a plurality of support legs 130 and 140.

The central shaft 110 may be installed below a seat part S of a chair 10 to connect the seat part S to the housing 120 and/or the plurality of support legs.

The central shaft 110 has a shape extending up and down, and a height of the chair 10 may be adjusted.

Specifically, the central shaft 110 may include a piston made of a metal material and a cylinder provided with an internal space so that the piston is able to reciprocate up and down, and a height control lever (not shown) provided on one of the central shaft 110, the seat part S, and an armrest part A may be further included.

The central shaft 110 moves up and down as a fluid present in the cylinder moves when a user pulls the height control lever, and the height of the seat part S may be easily adjusted, accordingly.

In the present invention, a case where the height control method of the central shaft 110 is of a hydraulic type has been described, but in addition to that, any height control method commonly employed in the central shaft 110 currently on sale, such as a gas type, a screw type, or the like, may be freely used without particular limitation. Furthermore, the height control may be implemented electrically.

The central shaft 110 may be of a non-rotating type or rotating type depending on whether or not the central shaft 110 is rotatable. Even when the central shaft 110 is of the rotating type, through a rotation control lever (not shown) provided on one of the central shaft 110, the seat part S, and the armrest part A, the central shaft 110 may be fixed to be non-rotatable, or rotation of the central shaft 110 may be restricted within a predetermined angle.

In addition, the central shaft 110 may be fixedly connected or rotatably connected to the seat part S and/or the housing 120.

Even when the central shaft 110 is rotatably connected to the seat part S and/or the housing 120, the central shaft 110 may be fixed to be non-rotatable with each other or rotation thereof may be restricted within a predetermined angle, through the rotation control lever (not shown).

The housing 120 is provided to surround the central shaft 110. For example, the housing 120 may be in close contact with the central shaft 110 so that there is no gap between the housing 120 and the central shaft 110, thereby giving a sense of stability even when the user sits on the chair 10 and the center of gravity of the chair 10 exists in various positions.

In addition, the housing 120 may be provided in a form that entirely surrounds the central shaft 110, or may be provided in a form that partially surrounds at least a lower portion of the central shaft 110.

The plurality of support legs 130 and 140 are connected to the housing 120. The plurality of support legs 130 and 140 may be connected to the housing 120 surrounding the lower portion of the central shaft 110, and may have a shape extending from the housing 120 by a predetermined length.

The central shaft 110, the housing 120, and the plurality of support legs 130 and 140 are formed to be separable from each other, or at least two of the central shaft 110, the housing 120, and the plurality of support legs 130 and 140 may be integrally formed.

When the central shaft 110, the housing 120, and the plurality of support legs 130 and 140 are formed to be separable from each other, even if any one of the central shaft 110, the housing 120, and the plurality of support legs 130 and 140 is damaged, only the damaged part may be replaced or repaired, thereby increasing the maintenance convenience of the bottom base 100.

Meanwhile, the plurality of support legs 130 and 140 each having a shape extending by a predetermined length from the housing 120 are formed to extend. The support legs 130 and 140 may properly distribute a load applied to the chair 10 to prevent the chair 10 from falling down due to an imbalance in the load applied to the chair 10 before and after the user sits on the chair.

In one embodiment, the plurality of support legs 130 and 140 may include at least one first support leg 130 having a predetermined extension length and at least one second support leg 140 having an extension length longer than the extension length of the first support leg 130.

In addition, in the above embodiment, the first support legs 130 may be constituted by first support legs 130 having a plurality of extension lengths. That is, since the first support legs 130 are constituted by support legs having different extension lengths, it is possible to prevent the chair 10 from falling down forward and/or sideways. In this case, in order to more clearly distinguish the support legs having different extension lengths, the support legs may comprises a fourth support leg (not shown in drawings) having an extension length different from the first support leg 130 and the second support leg 140. The fourth support leg may have an extension length longer than the first support leg 130, but shorter than the second support leg 140. The fourth support leg may extend forward and/or sideways to prevent the chair from falling forward and/or sideways.

Meanwhile, the first support leg 130 and the second support leg 140 may be spaced apart from each other at a predetermined interval, and since the first support leg 130 and the second support leg 140 are spaced apart from each other, the load applied to the chair 10 may be evenly distributed.

Referring to FIG. 2A, the plurality of support legs includes four first support legs 130 and one second support leg 140. The five support legs are formed to extend from the housing 120 at equal intervals from each other, but the number and spacing of the first support legs 130 and the second support leg 140 are not limited thereto and may be designed in various ways. Meanwhile, referring to FIG. 2B, the plurality of support legs includes four first support legs 130 and two second support leg 140. As such, the support legs may comprise a plurality of the second support leg 140.

By using the bottom base 100 provided with at least one second support leg 140 longer than the extended length of the first support leg 130, it is possible to prevent the fall-down of the chair provided with the bottom base 100 due to the center of gravity of the chair being tilted in a specific direction.

FIG. 3A is a side view illustrating the center of gravity of a user sitting on a chair when all of a plurality of support legs are the same, and FIG. 3B is a side view illustrating the center of gravity of a user sitting on a chair when a length of at least one of the plurality of support legs is different.

"O" shown in FIGS. 3A and 3B mean a distal end of at least one support leg serving as a rotational axis when the chair 10 falls down among the plurality of support legs, "r" means a distance from the rotational axis O to a center of gravity CM, "h" means a height of the center of gravity, and "w" means a distance from a point of contact obtained by drawing a vertical line from the center of gravity to a bottom surface to the rotational axis O.

In addition, in the following, a case where the point of contact obtained by drawing the vertical line from the center of gravity CM to the bottom surface is positioned outside the rotational axis O is indicated as $w>0$ (in FIG. 3A), and a case where the point of contact is positioned inside the rotational axis O is indicated as $w<0$ (in FIG. 3B).

Referring to FIGS. 3A and 3B, when the user sitting on the chair reclines back the backrest part backward or installs a multimedia device (e.g., a speaker mounting member) on at least one of the seat part, backrest part, and headrest part, the center of gravity CM may be biased toward the rear of the chair.

Since, in the chair 10 of FIG. 3A, the center of gravity CM is positioned outside the rotational axis O ($w>0$), so that moment (torque) is generated in a direction in which the chair 10 is to fall down, even if the user applies a relatively small force to the chair 10, the chair may easily fall down.

In contrast, referring to FIG. 3B in which the bottom base 100 according to one embodiment of the present invention is applied, since the center of gravity (CM) of the chair 10 is positioned inside the rotational axis O ($w<0$), moment (torque) is generated toward the inside of the chair based on the rotational axis O, contrary to the case of FIG. 3A.

In order for the chair 10 shown in FIG. 3B to fall down, the user should apply at least a force equal to or greater than the moment (torque) generated toward the inside of the chair to the outside of the chair 10 described above.

Therefore, the chair including the bottom base may be more stable against falling-down as compared to FIG. 3A.

FIGS. 3A and 3B shows a case in which the center of gravity CM of the chair 10 is tilted toward the rear, but the center of gravity may be biased in various directions.

In this case, it is possible to prevent the chair 10 from falling down by rotating the central shaft 110 and positioning the second support leg 140 to correspond to the direction in which the center of gravity CM is biased.

In addition, instead of extending the length of all the support legs to prevent the chair 10 from falling down, at least one second support leg 140 having the extension length longer than the extension length of the first support leg 130 may be provided.

By using the bottom base 100 in which only the length of the second support leg is extended, the space occupied by the bottom base 100 may be reduced, and thus space utilization and/or movement convenience of the chair 10 may be promoted.

In addition, the second support leg 140 may be disposed from the housing 120 toward the rear.

The second support leg 140 disposed toward the rear of the chair 10 may prevent the chair 10 from falling down when the center of gravity of the chair 10 is particularly biased toward the rear.

Figure 4:
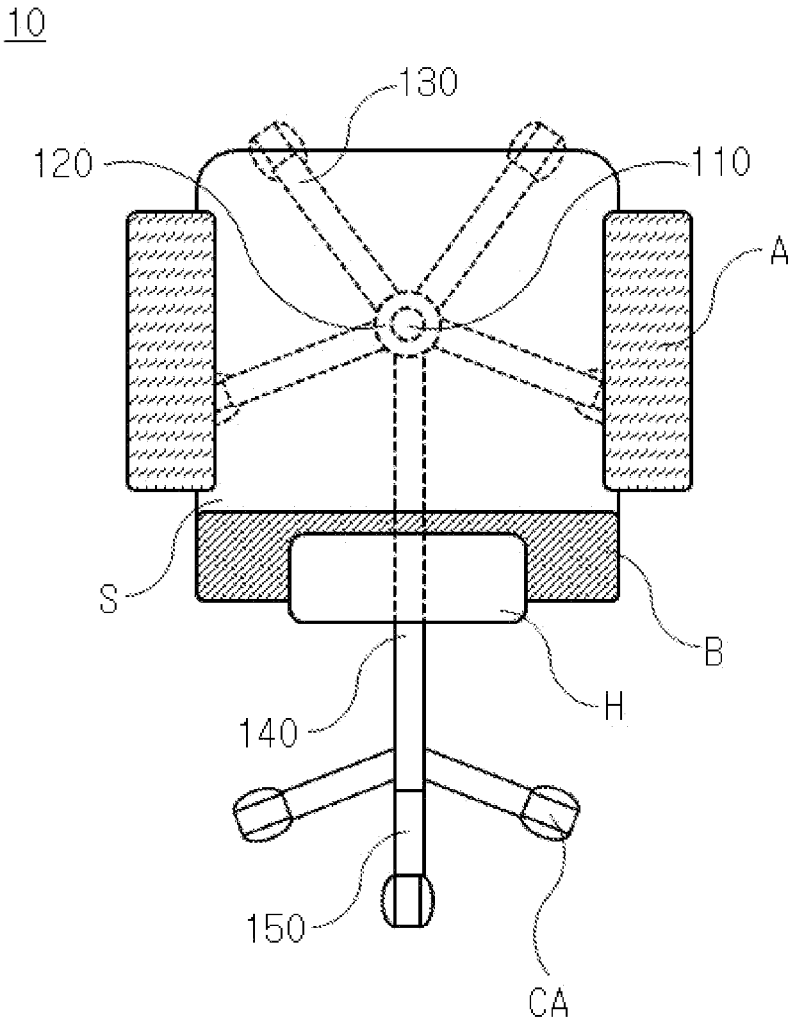
FIGS. 4 and 5 illustrate a chair including a bottom base according to another embodiment of the present invention.

FIG. 4 is a plan view of a bottom base 100 further provided with at least one third support leg 150 on the second support leg and a chair including the same.

Referring to FIG. 4, the second support leg 140 may further include at least one third support leg 150 extending from the distal end of the second support leg 140 toward the rear to have a predetermined length.

The third support leg 150 may more effectively prevent the chair 10 from falling down when the center of gravity of the chair 10 is particularly biased toward the rear.

Figure 5:
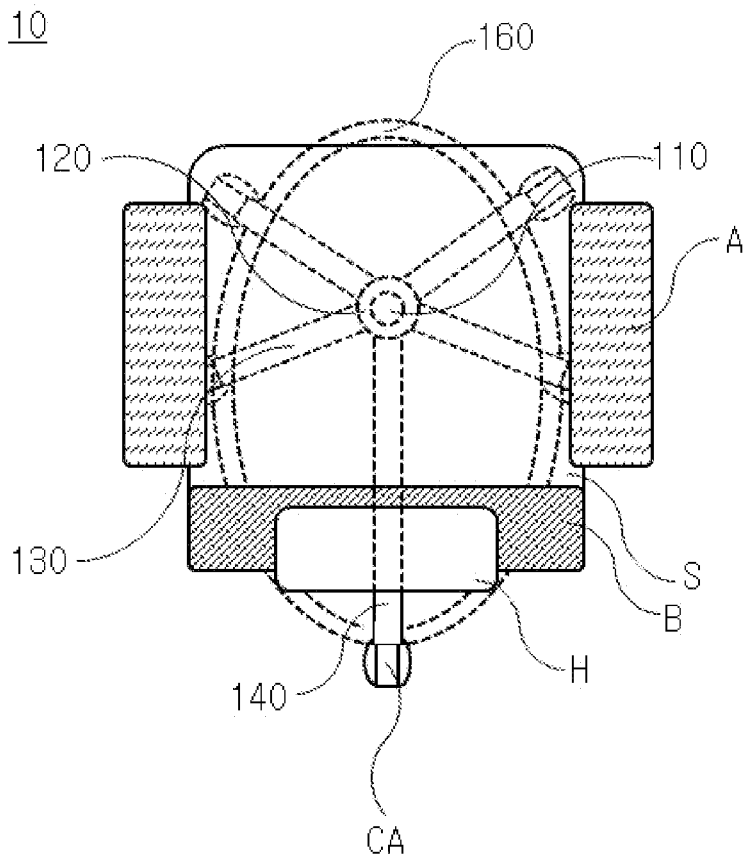

FIG. 5 is a plan view of a bottom base 100 provided with a reinforcing frame 160 according to one embodiment of the present invention and a chair 10 including the same.

The reinforcing frame 160 may be spaced apart from the housing 120 and connect the plurality of support legs 130 and 140, thereby preventing deformation of the plurality of support legs 130 and 140.

Specifically, the load of the user and/or the multimedia device (e.g., the speaker mounting member) applied to the chair 10 may be evenly distributed by the reinforcing frame 160 connecting the first support leg 130 and the second support leg 140 to each other.

Accordingly, it is possible to prevent deformation of any one of the plurality of support legs 130 and 140 due to the load being concentrated on the support leg.

In particular, since the center of gravity of the chair is positioned in the direction in which the second support leg 140 extends, a moment (torque) greater than that of the first support leg 130 may be applied to the second support leg 140. In addition, since the second support leg 140 has a longer length than the first support leg 130, a relatively greater moment (torque) may be applied to the second support leg 140.

The reinforcing frame 160 may connect the first support leg 130 and the second support leg 140 so that the load is distributed, thereby preventing deformation of the second support leg 140 due to the greater moment (torque) being applied to the second support leg 140.

Figure 6:
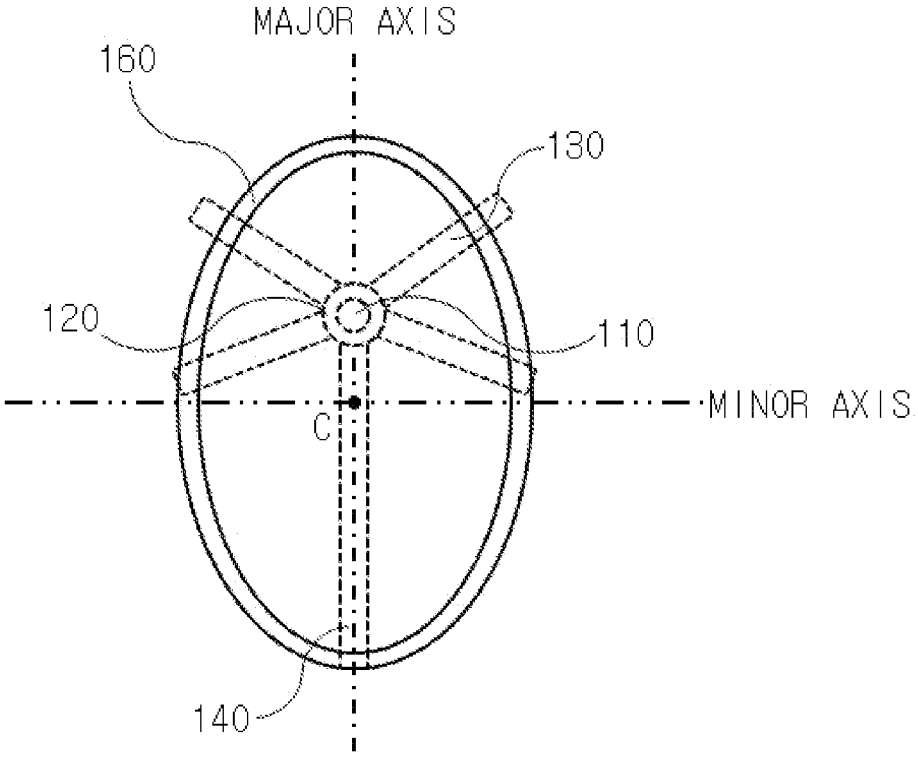
FIG. 6 is a plan view illustrating relative positions of a reinforcing frame and a central shaft illustrated in FIG. 5.

FIG. 6 is a plan view illustrating relative positions of the reinforcing frame 160 and the central shaft 110 illustrated in FIG. 5.

Referring to FIG. 6, the reinforcing frame 160 may have a shape in which a major axis exists along a direction from the front to the rear of the chair 10.

When the reinforcing frame 160 is formed by connecting the first support leg 130 and the second support leg 140 to be level with a floor surface on which the chair 10 is placed, the shape may be an elliptical shape with a major axis and a minor axis.

Since the reinforcing frame 160 has an elliptical shape with the major axis along the direction from the front to the rear of the chair 10, the load applied to the chair 10 may be more evenly distributed to the first support leg 130 and the second support leg 140.

As shown in FIG. 6, the reinforcing frame 160 shown in the elliptical shape may have the major axis and the minor axis, and a center C of the major axis of the reinforcing frame 160 may be positioned behind the central shaft 110.

Since the center of the major axis of the reinforcing frame 160 is positioned behind the central shaft 110, the load applied to the chair 10 0 may be more evenly distributed to the first support leg 130 and the second support leg 140.

That is, it is possible to more effectively prevent deformation of the second support leg 140 due to the greater moment (torque) being applied to the second support leg 140 than the first support leg 130.

The shape of the reinforcing frame 160 may have any shape (e.g., a rectangle, a rhombus, or the like) having a major axis and a minor axis other than the ellipse.

In addition, the reinforcing frame 160 may serve as a footrest when the user sits. The reinforcing frame 160 may serve as a footrest when a short user sits on the chair 10 or when the central shaft 110 extends to the maximum so that a user's feet do not touch the floor surface, thereby giving the user a sense of stability when the user sits thereon.

Figure 7:
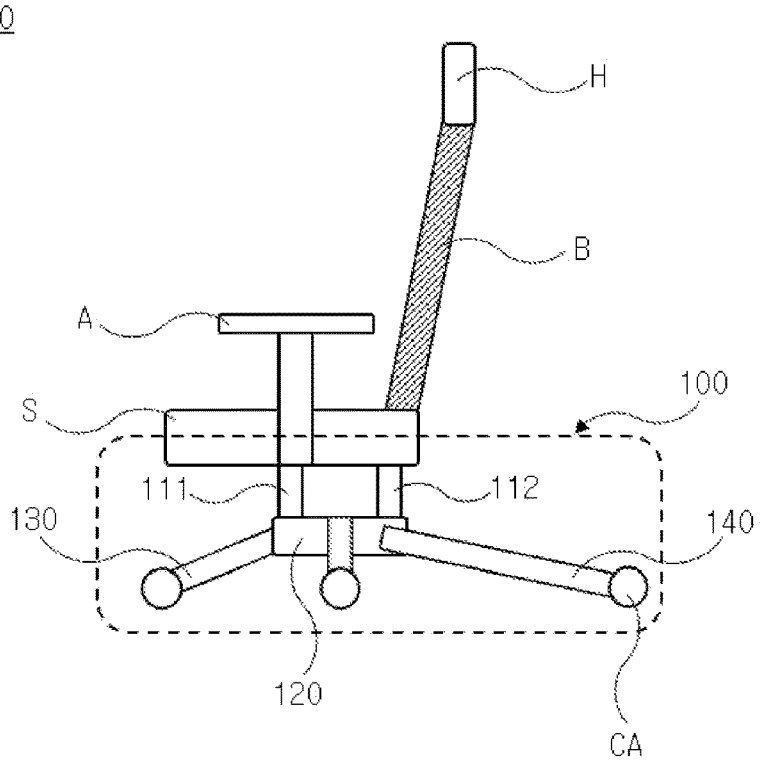
FIG. 7 is a side view of a chair including a bottom base according to still another embodiment of the present invention.
Figure 8:
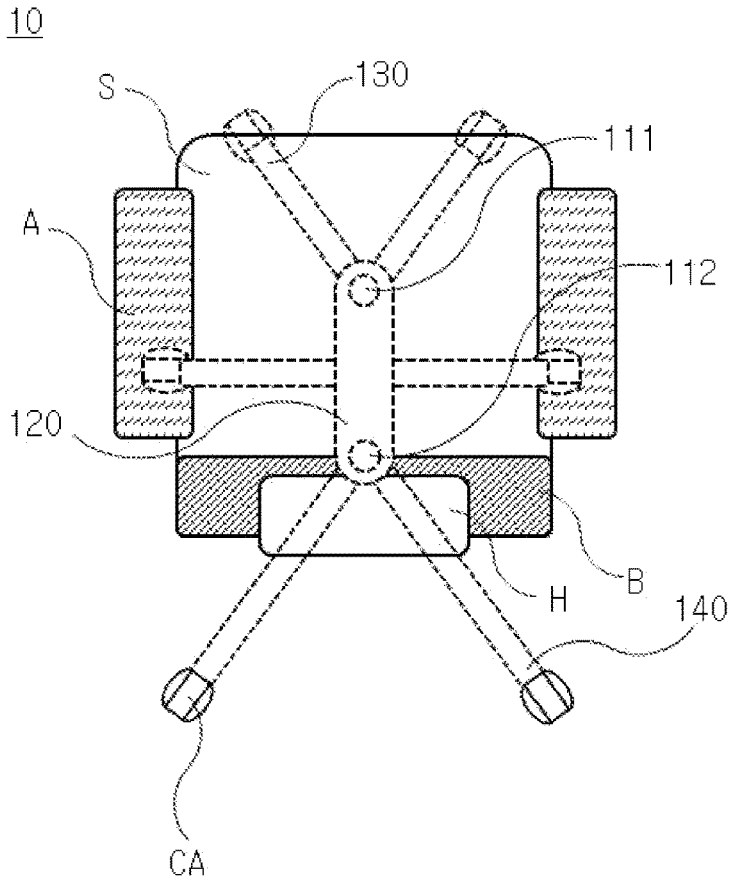
FIG. 8 is a plan view of the chair shown in FIG. 7.

FIG. 7 is a side view of a chair 10 including a bottom base 100 including a plurality of central shafts 111 and 112 according to still another embodiment of the present invention, and FIG. 8 is a plan view of the chair 10 shown in FIG. 7.

As shown in FIGS. 7 and 8, the plurality of central shafts 111 and 112 may be arranged along a direction from the front to the rear of the chair 10.

By configuring a plurality of central shafts as described above and arranging the central shafts along the direction from the front to the rear of the chair 10, a distal end of a support leg serving as a rotational axis when the chair 10 falls down may be positioned further to the front and/or rear than when one central shaft is provided.

By positioning the rotational axis further to the front and/or rear than when the central shaft is positioned at the center of the seat part S, moment (torque) in the direction ($w>0$) in which the chair 10 is to fall down may be reduced or moment (torque) may be applied toward the inside ($w<0$) of the chair.

Accordingly, even if the length of any one of the plurality of support legs 130 and 140 is not relatively extended, the possibility of the fall-down of the chair 10 due to the center of gravity of the chair 10 being biased toward the front or rear may be reduced.

According to one preferred embodiment, the central shafts may include the first central shaft 111 and the second central shaft 112.

In this case, the first central shaft 111 may be positioned in front of the second central shaft 112, and the second central shaft 112 may be positioned from the center of the seat part S toward the rear.

By positioning the second central shaft 112 behind the center of the seat part S, the fall-down of the chair 10 when the center of gravity of the chair 10 is particularly biased toward the rear may be prevented.

Although not separately shown, the seat part S may further include a central shaft extension member. The central shaft extension member is provided at the rear of the seat part S and extends toward the rear of the chair 10.

The second central shaft 112 may be installed on the central shaft extension member, thereby preventing the chair 10 from falling down when the center of gravity of the chair is biased toward the rear more effectively.

In addition, in the case of configuring a plurality of central shafts, it is sufficient that the same central shaft as the previously manufactured central shaft is disposed in plural, without the need to manufacture a separate component for preventing the chair 10 from falling down, and thus manufacturing convenience and economic efficiency of the bottom base 100 may be improved.

In addition, as a plurality of central shafts are configured, a force of the central shafts to lift the upper portion of the chair including the seat part is increased, so that even when the multimedia device having a predetermined weight is installed, it is possible to raise/lower the upper portion of the chair including the seat part.

Meanwhile, in FIG. 8, the housing 120 surrounding the central shafts 111 and 112 is shown as simultaneously surrounding the plurality of central shafts 111 and 112, but the housing 120 is not limited thereto, and may be formed to individually surround the plurality of central shafts 111 and 112.

In addition, in FIG. 8, the plurality of support legs 130 and 140 are shown as having two at the front, two at the sides, and two at the rear of the housing 120, but the number and spacing of the plurality of support legs 130 and 140 are not limited thereto and may be designed in various ways.

Figure 9:
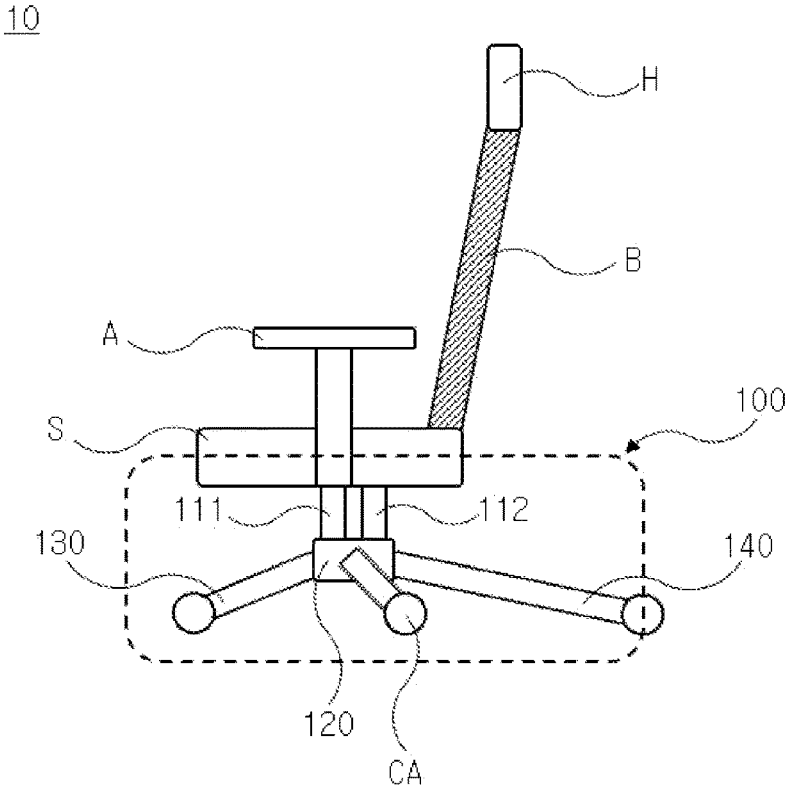
FIG. 9 illustrates a chair including a bottom base according to yet another embodiment of the present invention.

FIG. 9 is a side view of a chair 10 including a bottom base 100 according to yet another embodiment of the present invention.

Referring to FIG. 9, the bottom base 100 including the plurality of central shafts 111 and 112 may include at least one first support leg 130 having a predetermined extension length and at least one second support leg 140 having an extension length longer than the extension length of the first support leg 130.

The first support leg 130 and the second support leg 140 may be spaced apart from each other at a predetermined interval, and since the first support leg 130 and the second support leg 140 are spaced apart from each other, the load applied to the chair 10 may be evenly distributed to the first support leg 130 and the second support leg 140.

In addition, by using a plurality of central shafts 111 and 112 and the bottom base 100 provided with at least one second support leg 140 longer than the extension length of the first support leg 130 as described above, it is possible to more effectively prevent the fall-down of the chair 10 provided with the bottom base 100 due to the center of gravity of the chair being tilted in a specific direction.

Further, the second support leg 140 may be disposed from the housing 120 toward the rear.

By disposing the second support leg 140, which is longer than the first support leg 130, toward the rear of the chair 10, the case where the chair falls down due to the center of gravity of the chair being particularly biased toward the rear may be handled.

According to one preferred embodiment, the second support leg 140 may be disposed adjacent to the second central shaft 112.

When the second support leg 140 is disposed adjacent to the first central shaft 111, the rotational axis O positioned at the distal end of the second support leg may be positioned further toward the inner side of the chair than in the preferred embodiment.

In this case, since it is not possible to effectively prevent the fall-down of the chair 10 due to the center of gravity of the chair 10 being biased toward the rear, by disposing the second support leg 140 toward the rear to be adjacent to the second central shaft 112, it is possible to more effectively prevent backward fall-down of the chair 10.

Meanwhile, in the above embodiments, the housing and the plurality of support legs 130 and 140 may be integrally formed.

By integrally forming the housing and the plurality of support legs 130 and 140, it is possible to reduce the risk of damage that may occur in the process of coupling and/or separating the housing and the plurality of support legs 130 and 140, and to obtain a cost reduction effect according to the simplification of the manufacturing process.

Since the bottom base 100 and the chair 10 including the same, which have been shown in FIGS. 7 to 9, are substantially the same as the bottom base 100 and the chair 10 including the same, which have been shown in FIGS. 1 to 4, except that a plurality of central shafts are provided and the plurality of central shafts 111 and 112 are arranged along the direction from the front to the rear of the chair 10, a detailed description of the overlapping components will be omitted for convenience.

Although not separately shown, the bottom base 100 shown in FIGS. 7 to 9 may be provided with a reinforcing frame spaced apart from the housing 120 and connecting the plurality of support legs 130 and 140.

In addition, the reinforcing frame may have a shape in which a major axis exists along the direction from the front to the rear of the chair 10.

Since the reinforcing frame is substantially the same as the reinforcing frame shown in FIGS. 5 and 6, except that a plurality of central shafts are provided and are arranged along the direction from the front to the rear of the chair, a detailed description of the overlapping components will be omitted for convenience.

Meanwhile, in one embodiment of the present invention, each of the plurality of support legs 130 and 140 may further include a movable member CA. Specifically, the movable member may be formed at the distal end of each of the plurality of support legs 130 and 140 and may be in the form of a caster provided with at least one or more wheels.

In addition, when a plurality of movable members CA are provided at the distal ends of the plurality of support legs 130 and 140, the rotational axis of the chair 10 is relatively moved toward the outer side of the chair 10, and thus it is possible to prevent the chair 10 from falling down.

In this case, by disposing the plurality of movable members CA at the distal ends of the plurality of support legs 130 and 140 in an ellipse whose major axis exists along a direction toward the front/rear of the chair 10, it is possible to more effectively prevent the chair 10 from falling down.

Chair

In another aspect of the present invention, a chair including at least the bottom base 100, a headrest part, a backrest part, and a seat part according to various embodiments of the present invention may be provided.

Specifically, the chair is provided with at least a headrest part H for supporting a user's head, a backrest part B for supporting a user's back, and a seat part S for supporting a user's buttocks and legs.

The headrest part H may be installed on an upper portion of the backrest part B, and at this time, the headrest part H may be separated from the backrest part B or integrally formed therewith, as necessary.

The headrest part H, the backrest part B, and the seat part S may be provided such that the front or inside thereof (that is, a direction in which a user's back, waist, side, or the like, touches) is formed to have a material having a cushion feeling or is in the form of being padded with a material having a cushioning feeling for the convenience of a sitting user.

In addition, a woofer speaker (not shown) may be additionally provided on the front or inside of the backrest part B and/or the seat part S. Since vibration generated by the woofer speaker may be directly transmitted to the user sitting on the chair 10, there is an advantage in that a more lively user experience may be provided.

The woofer speaker provided inside the backrest part B and/or the seat part S may be installed in an appropriate number for implementation of a multi-channel sound system.

Additionally, at least one selected from a heating device, a ventilation device, and a massaging device may be provided on the backrest part B and/or the seat part S for convenience of the user sitting on the chair 10.

The above-described bottom base 100 for preventing a chair from falling down may be provided under the seat part S, and the chair 10 may be prevented from falling down through the bottom base 100. In addition, the seat part S and the bottom base 100 may be integrally formed and provided as a configuration in which it is impossible to distinguish the seat part S and the bottom base 100 from each other.

Meanwhile, although not separately shown, a vibration mitigating member (not shown) may be selectively provided between the seat part S and the bottom base 100. The vibration mitigating member serves to prevent or alleviate vibration generated from a plurality of speakers disposed on a relatively upper portion of the seat part S from being transmitted to a lower portion of the chair.

In addition, the chair 10 may further include an armrest part A for supporting a user's side. As shown in FIGS. 1 to 2B, the armrest part A may be provided as a separate component installed on both sides of the seat part S, and otherwise, or alternatively, may be provided as an integral component with the seat part S and/or the backrest part B.

Figure 10:
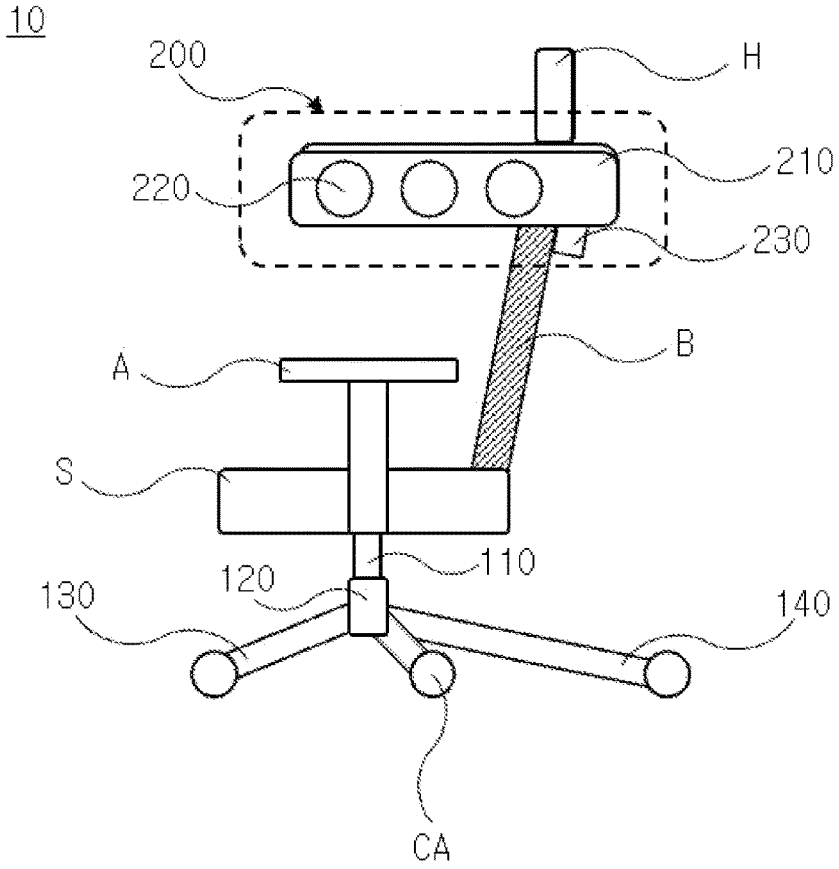
FIGS. 10 to 12 illustrate a chair including a bottom base and a speaker mounting member according to one embodiment of the present invention.
Figure 11:
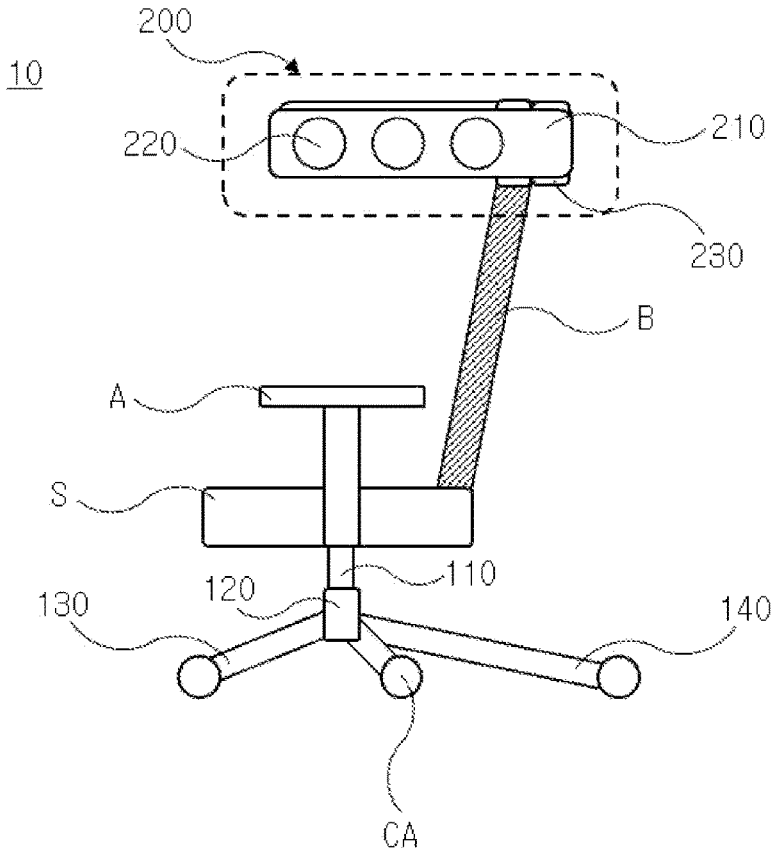
Figure 12:
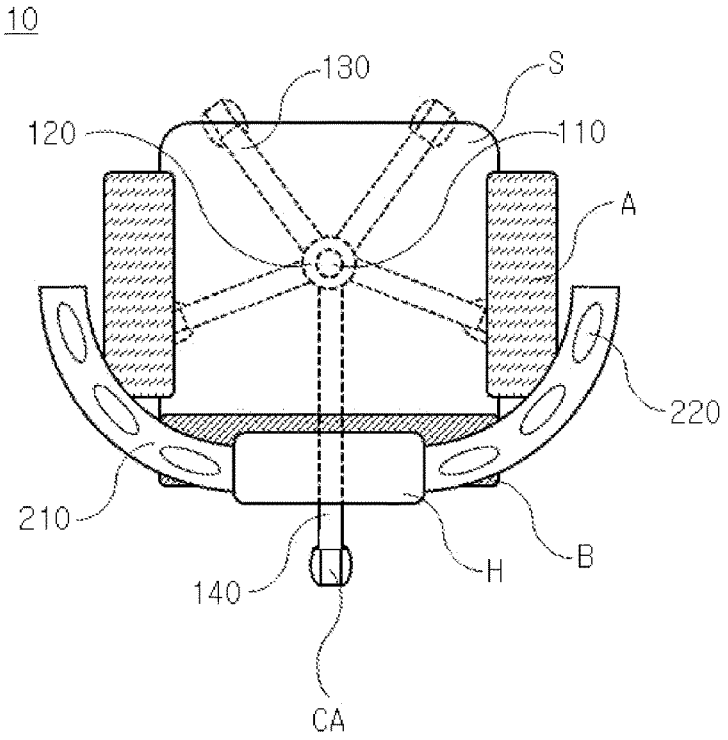

FIGS. 10 to 12 illustrate a chair 10 further including a speaker mounting member 200 according to one embodiment of the present invention.

Referring to FIGS. 10 and 11, the speaker mounting member 200 installed on at least one of the headrest part H, the backrest part B, and the seat part S and implementing a multi-channel sound system around a user sitting on the chair 10 by receiving multi-channel sound signals may be provided.

The speaker mounting member 200 may be directly installed on at least one of the headrest part H, the backrest part B, and the seat part S, as shown in FIG. 12, or may be installed to be connected to a separate support member 230 positioned behind at least one of the headrest part H, the backrest part B, and the seat part S, as shown in FIGS. 10 and 11.

More specifically, the speaker mounting member 200 may include at least one frame 210 installed on the backrest part B.

The frame 210 installed on the backrest part B may be installed in an appropriate number required for implementation of the multi-channel sound system.

In addition, the frame 210 may be provided to extend in a front direction of the chair 10, and the speaker installation region in which at least one speaker 220 is installed may be defined along an extension direction of the frame 210.

The speaker installation region is preferably defined inside the frame 210 to face the user sitting on the chair 10, but when the speaker 220 is installed through the frame 210, the installation region does not necessarily have to be defined inside the frame 210.

The speaker 220 may be directly installed on the speaker installation region, but is not necessarily limited thereto, and a separate speaker installation table may be interposed between the speaker installation region and the speaker.

The speaker 220 may be provided integrally with the frame 210 or provided to be detachable from the frame 210. In addition, the frame 210 may be configured by connecting a plurality of speakers 220 to each other.

The speaker 220 may be a finished speaker product, a speaker unit operated as a finished product by being connected to a drive unit separately provided in the speaker installation region, a display type speaker, or a thin film speaker, may include a one-way and multi-way speaker, and may operate by receiving sound signals through wires or wirelessly.

Meanwhile, when a plurality of speakers 220 are configured, the plurality of speakers 220 may be installed to be spaced apart from each other along the extension direction of the frame 210 inside the frame 210.

At least one of the plurality of speakers 220 may be positioned in front of the user sitting on the chair 10 and output sound from the front of the user toward the user.

As described above, by installing the plurality of speakers 220 along the extending direction of the frame 210 from the front of the user toward the user, there is an advantage in that the user may experience a lively sound as if the user is present in a video or a game environment that is actually reproduced only by sitting on the chair 10.

Although not separately shown, the speaker 220 may receive a sound signal through wires or wirelessly, and when the speaker 220 receives a sound signal wirelessly, a wireless receiver may be provided in the speaker mounting member 200 or the chair 10 on which the speaker mounting member is installed.

The wireless receiver may perform wireless transmission/reception with a sound source (e.g., a home theater, TV, set-top box, sound bar, computer, mobile phone, tablet, or the like) in a manner such as Wi-Fi, Bluetooth, DECT or Li-Fi.

The speaker mounting member 200 may be provided with a fixing device (not shown) for fixing the support member 230 to the chair 10, and the fixing device is preferably provided on the support member 230.

A fixing method is not particularly limited, and known methods such as a fitting method, a knot method, a screw fastening method, or the like, for firmly fixing the speaker mounting member 200 having a predetermined load to the chair 10 may be used.

In another embodiment of the present invention, the speaker mounting member 200 may include at least one frame 210 installed on the headrest part H.

The frame 210 may be provided to extend in the front direction of the chair 10, and the speaker installation region in which at least one speaker 220 is installed may be defined along the extension direction of the frame 210.

In this case, the frame may extend from the headrest part H toward the top of the user sitting on the chair 10 (not shown), or may extend in a lateral direction.

A detailed description of the frame 210 installed on the headrest part H, the speaker 220 installed on the frame, and the speaker mounting member 200 including the same will be the same as that of the frame 210 installed on the backrest part B, the speaker 220 with the frame installed, and the speaker mounting member 200 including the same shown in FIG. 10, unless structurally restricted.

Meanwhile, the chair 10 may be provided with the speaker mounting member 200 on at least one of the headrest part H, the backrest part B, and the seat part S, and thereby, the center of gravity of the chair may be higher than when the speaker mounting member 200 is not included, and at the same time, may be moved toward the rear.

When the center of gravity of the chair 10 is higher and moved toward the rear, a distance r from the rotational axis of the chair 10 to the center of gravity increases toward the direction in which the chair 10 is to fall down, and thus the chair may be more vulnerable to fall-down.

However, since the chair includes the bottom base 100 described above, the user may experience a lively sound as if the user is present in a video or a game environment that is actually reproduced only by sitting on the chair 10, and at the same time, the fall-down of the chair 10 may be effectively prevented.

In a bottom base according to various embodiments of the present invention, a distal end of at least one support leg is extended to be positioned outside a chair as much as possible so that the center of gravity of the chair exists on a range of the bottom base, and thereby it is possible to prevent the chair from falling down due to the center of gravity being biased in a specific direction.

In particular, in a bottom base according to the present invention, a user can recline a backrest part of a chair provided with the bottom base or install a device such as a speaker mounting member on the chair, and thereby it is possible to prevent the chair from falling down when the center of gravity of the chair is biased toward the rear.

In addition, a bottom base according to the present invention is provided with a reinforcing frame extending from a housing and connecting a plurality of support legs that are spaced apart from each other, and thereby it is possible to improve a phenomenon in which any one of the plurality of support legs is deformed due to the load being concentrated to the support leg.

In particular, a reinforcing frame installed on the bottom base according to the present invention can prevent deformation of a second support leg having a longer length than a first support leg due to the moment (torque) applied to the second support leg.

Meanwhile, a chair including the bottom base according to various embodiments of the present invention is provided with a speaker mounting member installed on at least one of a headrest part, a backrest part, and a seat part, and implementing a multi-channel sound system around a user sitting on the chair by receiving multi-channel sound signals, thereby having an advantage in that the user can experience a lively sound as if the user is present in a video or a game environment that is actually reproduced only by sitting on the chair.

In addition, a chair according to the present invention includes the above-described bottom base for preventing the chair from falling down, thereby having an advantage in that the user does not have to worry about the chair falling down while sitting on the chair and experiencing a lively sound.

In addition to the above effects, specific effects of the present invention will be described together while describing specific details for carrying out the present invention.

In the above, the embodiments of the present invention have been described, but it will be appreciated by those skilled in the art that various variations and modifications could be made to the present invention through addition, alteration, deletion, etc. of elements within the scope not departing from the spirit of the present invention described in the claims, which will also be included within the scope of the present invention.

What is claimed is:

1. A bottom base for preventing a chair from falling down, the bottom base comprising:

a plurality of central shafts;

a housing; and a plurality of support legs, wherein each of the plurality of central shafts has an upper end that is coupled with a bottom surface of a seat part of the chair, each of the plurality of central shafts has a shape extending in a vertical direction, and the plurality of central shafts have the same length, wherein the housing accommodates a lower end of each of the plurality of central shafts, wherein each of the plurality of support legs is coupled with the housing and has a shape extending from the housing by a predetermined length, wherein the plurality of central shafts include a first central shaft and a second central shaft be arranged along a direction from the front to the rear of the chair when a user sits in a normal direction on the chair, the first central shaft is positioned in front of the second central shaft, and the second central shaft is positioned from a center of the seat part toward the rear, wherein the plurality of support legs include at least one first support leg having a predetermined extension length and at least one second support leg having an extension length longer than the extension length of the first support leg, and wherein the first support leg is disposed from the housing toward the front and the second support leg is disposed from the housing toward the rear.

2. The bottom base of claim 1, wherein the second support leg is disposed adjacent to the second central shaft.

3. The bottom base of claim 1, wherein the housing and the support leg are integrally formed.

4. A chair that includes at least 1) a headrest part for supporting a user's head, 2) a backrest part for supporting a user's back and waist, and 3) a seat part for supporting a user's buttocks and legs, the chair comprising the bottom base according to claim 1 provided under the seat part.

5. The chair of claim 4, wherein the chair is provided with a speaker mounting member installed on at least one of the headrest part, the backrest part, and the seat part and implementing a multi-channel sound system around the user sitting on the chair by receiving multi-channel sound signals.

6. The chair of claim 5, wherein the speaker mounting member includes at least one frame installed on the backrest part, the frame is provided to extend in a front direction of the chair, and a speaker installation region in which at least one speaker is installed is defined along an extension direction of the frame.

7. The chair of claim 6, wherein a plurality of speakers are installed to be spaced apart from each other along the extension direction of the frame inside the frame, and at least one of the plurality of speakers is positioned in front of the user sitting on the chair and outputs sound from the front of the user toward the user.

8. The chair of claim 5, wherein the speaker mounting member includes at least one frame installed on the headrest part, the frame is provided to extend in a front direction of the chair, and a speaker installation region in which at least one speaker is installed is defined along an extension direction of the frame.

9. The chair of claim 8, wherein the frame extends from the headrest part toward an upper direction of the user sitting on the chair.

10. The chair of claim 8, wherein the frame extends from the headrest part toward a lateral direction of the user sitting on the chair.

11. The chair of claim 8, wherein a plurality of speakers are installed to be spaced apart from each other along the extension direction of the frame inside the frame, and at least one of the plurality of speakers is positioned in front of the user sitting on the chair and outputs sound from the front of the user toward the user.

12. A bottom base for preventing a chair from falling down, the bottom base comprising:

a plurality of central shafts;

a housing; and a plurality of support legs, wherein each of the plurality of central shafts has an upper end that is coupled with a bottom surface of a seat part of the chair, each of the plurality of central shafts has a shape extending in a vertical direction, and the plurality of central shafts have the same length, wherein the housing accommodates a lower end of each of the plurality of central shafts, wherein each of the plurality of support legs is coupled with the housing and has a shape extending from the housing by a predetermined length, wherein the housing has a straight bar shape having a first rounded distal end and a second rounded distal end, wherein the housing is positioned parallel with the bottom surface of the seat part of the chair, wherein a first central shaft of the plurality of central shafts is coupled with a portion adjacent to the first rounded distal end, and a second central shaft of the plurality of central shafts is coupled with a portion adjacent to the second rounded distal end, and wherein the plurality of support legs comprise:

first and second support legs extended from the first rounded distal end;

third and fourth support legs extended from the second rounded distal end;

a fifth support leg extended from a first side of the housing; and a sixth support leg extended from a second side of the housing.

* * * * *